US011306952B2

(12) United States Patent
Ishiyama

(10) Patent No.: US 11,306,952 B2
(45) Date of Patent: Apr. 19, 2022

(54) REFRIGERATION CYCLE APPARATUS

(71) Applicant: Mitsubishi Electric Corporation, Tokyo (JP)

(72) Inventor: Hiroki Ishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 18 days.

(21) Appl. No.: 16/767,648

(22) PCT Filed: Dec. 6, 2017

(86) PCT No.: PCT/JP2017/043753
§ 371 (c)(1),
(2) Date: May 28, 2020

(87) PCT Pub. No.: WO2019/111341
PCT Pub. Date: Jun. 13, 2019

(65) Prior Publication Data

US 2020/0300514 A1 Sep. 24, 2020

(51) Int. Cl.
*F25B 31/00* (2006.01)
*F25B 43/00* (2006.01)
*F25B 49/02* (2006.01)

(52) U.S. Cl.
CPC ..... *F25B 31/004* (2013.01); *F25B 43/006* (2013.01); *F25B 49/02* (2013.01);
(Continued)

(58) Field of Classification Search
CPC ..... F25B 2400/01; F25B 2400/23; F25B 2500/31; F25B 2700/2105; F25B 31/004; F25B 43/006; F25B 49/02
See application file for complete search history.

(56) References Cited

U.S. PATENT DOCUMENTS

2003/0196450 A1* 10/2003 Higami ..... F25B 45/00 62/475
2014/0230476 A1* 8/2014 Yura ..... F25B 31/002 62/192

FOREIGN PATENT DOCUMENTS

CN 105299957 A 2/2016
DE 102013004064 A1 9/2014
(Continued)

OTHER PUBLICATIONS

The Extended European Search Report dated Oct. 30, 2020 issued in corresponding EP application No. 17934121.9.
(Continued)

*Primary Examiner* — Henry T Crenshaw
(74) *Attorney, Agent, or Firm* — Posz Law Group, PLC

(57) ABSTRACT

A refrigeration cycle apparatus includes a refrigerant circuit in which refrigerant circulates in the order of a compressor, an oil separator, a first heat exchanger, a decompressing apparatus, and a second heat exchanger and returns to the compressor. The refrigeration cycle apparatus further includes: an oil reservoir that stores refrigeration oil; a first pipe that connects the oil separator and the oil reservoir, the first pipe sends the refrigeration oil separated by the oil separator to the oil reservoir; a second pipe that connects the oil reservoir and a suction side of the compressor; a third pipe that connects the oil reservoir and the suction side of the compressor at a position lower than a position at which the second pipe is connected to the oil reservoir; and a heater that heats the refrigeration oil separated by the oil separator.

2 Claims, 8 Drawing Sheets

(52) U.S. Cl.
CPC ..... *F25B 2400/01* (2013.01); *F25B 2400/23* (2013.01); *F25B 2700/2105* (2013.01)

(56) References Cited

FOREIGN PATENT DOCUMENTS

| | | | | |
|---|---|---|---|---|
| JP | S63-55054 | U | | 4/1988 |
| JP | H05-264110 | A | | 10/1993 |
| JP | H05-312418 | A | | 11/1993 |
| JP | 2008-139001 | A | | 6/2008 |
| JP | 2016-075397 | A | | 5/2016 |
| JP | WO 2016 121184 | | * | 8/2016 |
| JP | 2016-161211 | A | | 9/2016 |
| WO | 2016/121184 | A1 | | 8/2016 |

OTHER PUBLICATIONS

International Search Report of the International Searching Authority dated Feb. 27, 2018 for the corresponding international application No. PCT/JP2017/043753 (and English translation).
Japanese Office Action dated Feb. 16, 2021, issued in corresponding Japanese Patent Application No. 2019-557913 (and English Machine Translation).
Office Action dated May 31, 2021, issued in corresponding CN Patent Application No. 201780097303.1 (and English Machine Translation).
Office Action dated Nov. 5, 2021, issued in corresponding CN Patent Application No. 201780097303.1 (and English Machine Translation).
Office Action dated Feb. 2, 2022 issued in counterpart European application No. 17934121.9.

* cited by examiner

REFRIGERATION CYCLE APPARATUS

CROSS REFERENCE TO RELATED APPLICATION

This application is a U.S. national stage application of PCT/JP2017/043753 filed on Dec. 6, 2017, the contents of which are incorporated herein by reference.

TECHNICAL FIELD

The present invention relates to a refrigeration cycle apparatus, in particular, a refrigeration cycle apparatus including an oil separator configured to separate refrigeration oil from refrigerant gas supplied from a compressor.

BACKGROUND ART

Oil separators are provided in some types of refrigeration cycle apparatuses in order to avoid an operation that may cause exhaustion of refrigeration oil in compressors. Each of the oil separators is configured to separate the refrigeration oil from refrigerant gas discharged from the compressor. However, when a large amount of oil is returned to the compressor during a normal operation, an excess of oil is provided in the compressor, thus resulting in decreased performance, disadvantageously. To address this, a refrigeration cycle apparatus disclosed in Japanese Patent Laying-Open No. 2008-139001 (Patent Literature 1) is provided with an oil reservoir container so as to store surplus oil in the oil reservoir container during a normal operation and cause the surplus oil stored therein to flow to a compressor during an oil exhaustion operation.

This refrigeration cycle apparatus includes a refrigerant circuit for performing a vapor-compression refrigeration cycle, the refrigerant circuit including: an oil separator connected to a discharge side of the compressor; the oil reservoir container that communicates with the oil separator, the oil reservoir container being configured to store refrigeration oil separated by the oil separator; and a connection pipe connected to the oil reservoir container and a suction side of the compressor, the connection pipe having an opening/closing valve to return the refrigeration oil in the oil reservoir container to the suction side of the compressor.

The oil reservoir container constitutes a sealed container and is connected to the oil separator by an oil inflow pipe. The oil reservoir container is disposed below the oil separator. The oil reservoir container is configured to allow the refrigeration oil separated by the oil separator to flow thereinto via the oil inflow pipe due to its weight. That is, the surplus oil collecting mechanism is configured to collect, into the oil reservoir container, a whole of the refrigeration oil flowing from the compressor and separated by the oil separator.

CITATION LIST

Patent Literature

PTL 1: Japanese Patent Laying-Open No. 2008-139001 (claim 1 and paragraph 0044)

SUMMARY OF INVENTION

Technical Problem

When the oil reservoir container is provided, refrigerant is dissolved in the oil while external air has a low temperature, thus resulting in a low oil concentration. This leads to oil exhaustion in the compressor. Such a phenomenon is noticeable particularly while the compressor is non-operational. Even with the oil reservoir, oil exhaustion cannot be prevented completely.

In the refrigeration cycle apparatus disclosed in Japanese Patent Laying-Open No. 2008-139001, the refrigerant cannot be suppressed from being dissolved in the refrigeration oil in the oil separator and the oil reservoir container while it is non-operational, with the result that an oil concentration of liquid in the oil reservoir container is decreased, disadvantageously. Moreover, when starting the operation of the compressor, mixed liquid discharged from the compressor while it is operational and having a low oil concentration flows into the oil reservoir container, with the result that the oil concentration of the liquid in the oil reservoir container is decreased, disadvantageously. When the mixed liquid having a low oil concentration flows from the oil reservoir into the compressor, oil becomes exhausted in the compressor. This may result in decreased reliability of the compressor.

Moreover, when the refrigeration oil is stored in the oil reservoir container, the refrigerant is dissolved in the refrigeration oil, with the result that an amount of refrigerant in the refrigerant circuit is decreased. Accordingly, the amount of refrigerant in the refrigerant circuit becomes less than or equal to an appropriate amount of refrigerant, thus resulting in decreased performance of the refrigerating cycle. To maintain the amount of refrigerant at the appropriate amount of refrigerant in the refrigerant circuit, an amount of refrigerant sealed in the refrigerant circuit is increased, disadvantageously.

Moreover, when the refrigerant is dissolved in the refrigeration oil within the oil reservoir container, a volume thereof is increased, with the result that overflow may be caused in the oil reservoir container. When overflow is caused in the oil reservoir container, an oil separation ratio is decreased in the oil separator, with the result that performance of the refrigerating cycle and reliability of the compressor are decreased.

The present invention has been made to solve the foregoing problems, and has an object to provide a refrigeration cycle apparatus that can maintain a concentration of refrigeration oil in an oil reservoir container and that can prevent oil exhaustion in a compressor.

Solution to Problem

The present disclosure relates to a refrigeration cycle apparatus. The refrigeration cycle apparatus includes: a refrigerant circuit in which refrigerant circulates in the order of a compressor, an oil separator, a first heat exchanger, a decompressing apparatus, and a second heat exchanger and returns to the compressor; an oil reservoir configured to store refrigeration oil; a first pipe that connects the oil separator and the oil reservoir, the first pipe being configured to send the refrigeration oil separated by the oil separator to the oil reservoir; a second pipe that connects the oil reservoir and a suction side of the compressor; a third pipe that connects the oil reservoir and the suction side of the compressor at a position lower than a position at which the second pipe is connected to the oil reservoir; and a heater configured to heat the refrigeration oil separated by the oil separator.

Advantageous Effects of Invention

According to the present invention, since decrease in the oil concentration of the liquid stored in the oil reservoir can be prevented by the heater configured to heat the refrigeration oil separated by the oil separator, occurrence of oil exhaustion in the compressor can be prevented.

DESCRIPTION OF EMBODIMENTS

Figure 1:
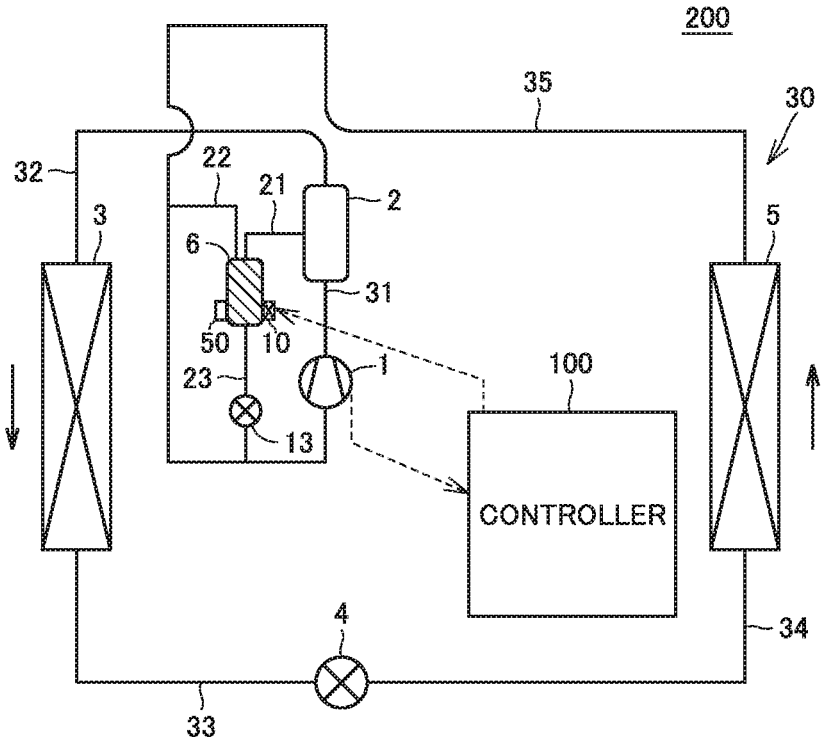
FIG. 1 shows a configuration of a refrigeration cycle apparatus according to a first embodiment.

The following describes embodiments of the present invention in detail with reference to figures. It should be noted that in the figures described below, a relation in sizes among respective component members may differ from an actual relation. Moreover, in the figures below, the same reference characters are given to the same or corresponding components. This applies to the entire content of the specification. Furthermore, embodiments of components described in the entire content of the specification are just exemplary, rather than limitation.

First Embodiment (Configuration of Refrigeration Cycle Apparatus)

FIG. 1 shows a configuration of a refrigeration cycle apparatus according to a first embodiment. A refrigeration cycle apparatus 200 shown in FIG. 1 includes a refrigerant circuit 30 in which refrigerant circulates in the order of a compressor 1, an oil separator 2, a first heat exchanger 3 (high-pressure side), a decompressing apparatus 4, and a second heat exchanger 5 (low-pressure side) and returns to compressor 1. The elements of refrigerant circuit 30 are connected to one another by pipes 31 to 35.

Refrigeration cycle apparatus 200 further includes: an oil reservoir 6 configured to store refrigeration oil; a first pipe 21; a second pipe 22; a third pipe 23; and a heater 10 configured to heat the refrigeration oil separated by oil separator 2.

First pipe 21 connects oil separator 2 and oil reservoir 6, and is configured to send the refrigeration oil separated by oil separator 2 to oil reservoir 6. Second pipe 22 connects oil reservoir 6 and low-pressure pipe 35 at the suction side of compressor 1. Third pipe 23 connects oil reservoir 6 and low-pressure pipe 35 at a position lower than the position at which second pipe 22 is connected to oil reservoir 6.

Refrigeration cycle apparatus 200 further includes: a temperature sensor 50 configured to detect a temperature of oil reservoir 6; and a controller 100 configured to control heater 10 to heat the refrigeration oil when the temperature detected by temperature sensor 50 is lower than a defined temperature.

Refrigeration cycle apparatus 200 further includes an oil returning amount regulating valve 13 provided at third pipe 23. Oil returning amount regulating valve 13 is a valve configured to adjust a flow rate of the refrigeration oil to be returned from oil reservoir 6 to compressor 1.

Mixed liquid flows from oil separator 2 into oil reservoir 6 via first pipe 21 serving as an oil returning pipe, the refrigeration oil is returned from oil reservoir 6 to compressor 1 via third pipe 23 serving as an oil returning pipe and oil returning amount regulating valve 13, and the refrigerant gas is returned from oil reservoir 6 to compressor 1 via second pipe 22 serving as a gas removing pipe. In the first embodiment, heater 10 is provided at oil reservoir 6 to gasify the refrigerant dissolved in the refrigeration oil.

Figure 2:
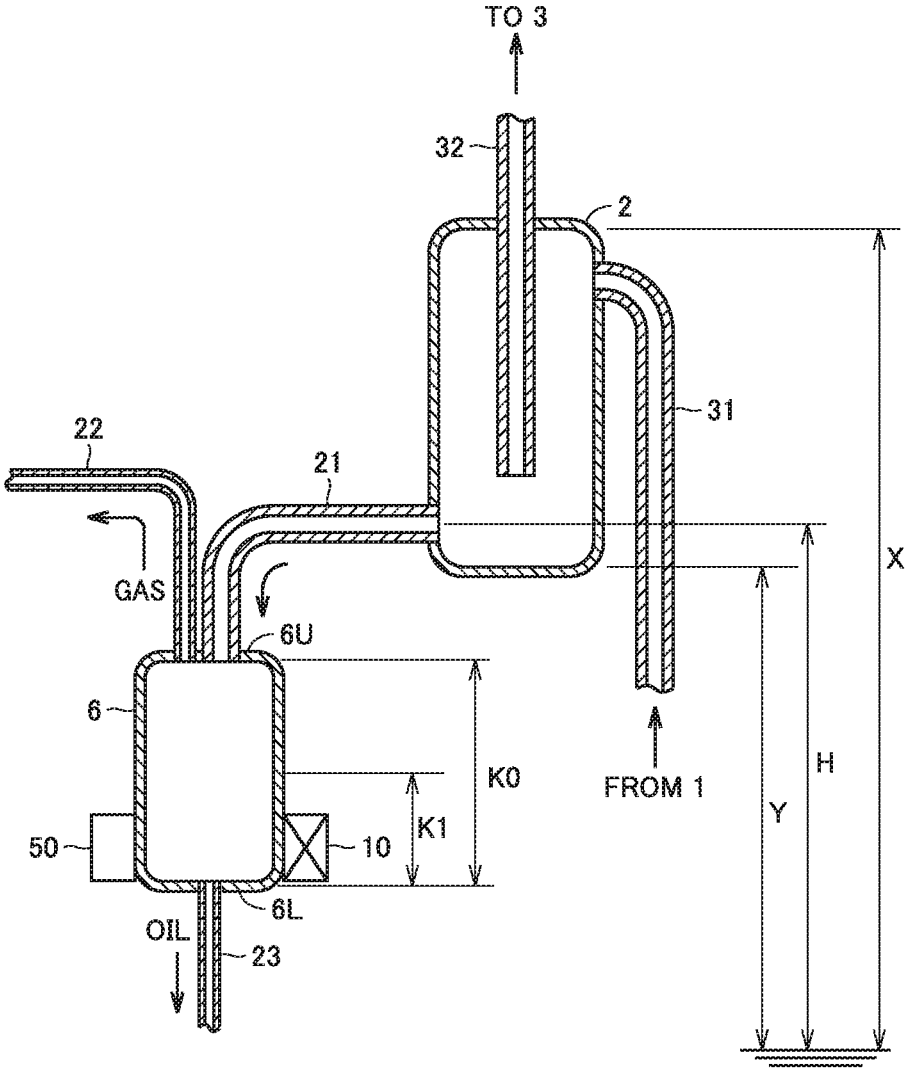
FIG. 2 is a partial enlarged view showing a connection between an oil separator 2 and an oil reservoir 6 in detail.

FIG. 2 is a partial enlarged view showing a connection between oil separator 2 and oil reservoir 6 in detail. With reference to FIG. 1 and FIG. 2, oil separator 2 is connected between compressor 1 and first heat exchanger 3 at the high-pressure side by pipes 31, 32. An upper base surface 6U of oil reservoir 6 is connected to oil separator 2 by first pipe 21. Also, upper base surface 6U of oil reservoir 6 is connected, by second pipe 22, to low-pressure pipe 35 between compressor 1 and second heat exchanger 5 at the low-pressure side. A lower base surface 6L of oil reservoir 6 is connected, by third pipe 23 serving as an oil removing pipe, to low-pressure pipe 35 between compressor 1 and second heat exchanger 5 at the low-pressure side.

Oil reservoir 6 is installed below oil separator 2. Accordingly, the liquid in oil separator 2 flows into oil reservoir 6 via first pipe 21 due to gravity.

One end of first pipe 21 is connected to upper base surface 6U of oil reservoir 6. The other end of first pipe 21 is connected to a position at a height H from a ground. Height H satisfies $Y \leq H \leq Y+(X-Y)/2$. X represents a distance between the ground (a bottom surface of an outdoor unit) and an upper end of oil separator 2. Y represents a distance between the ground (the bottom surface of the outdoor unit) and a lower end of oil separator 2.

Moreover, heater 10 for heating is installed at a position close to the connection position of third pipe 23 for oil removing relative to the connection position of second pipe 22, which is connected to the housing of oil reservoir 6, for gas removing.

Second pipe 22 connects upper base surface 6U of oil reservoir 6 and low-pressure pipe 35. Third pipe 23 connects lower base surface 6L of oil reservoir 6 and low-pressure pipe 35. Heater 10 is installed to be close to the attachment position of third pipe 23 relative to a center of oil reservoir 6 in a height direction in oil reservoir 6. That is, the installation position of heater 10 is lower than a height K1, which is ½ of a height K0 of a housing of oil reservoir 6.

Figure 3:
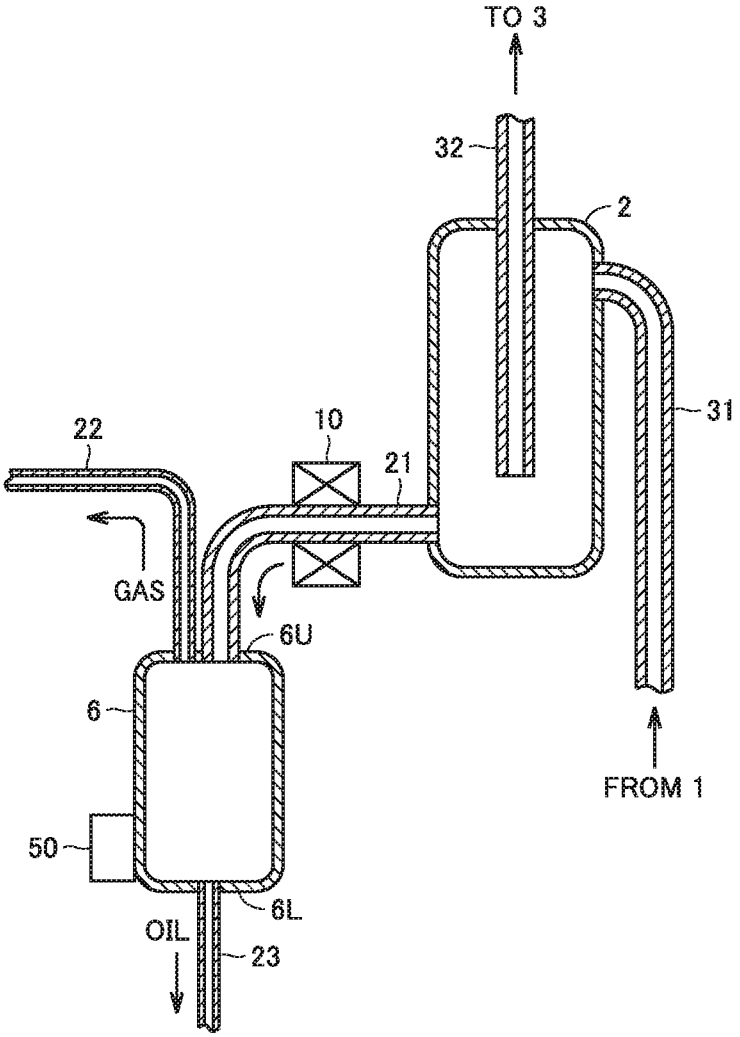
FIG. 3 shows a modification of an installation position of a heater 10.

FIG. 3 shows a modification of the installation position of heater 10. Instead of installing heater 10 at the side surface of oil reservoir 6 as shown in FIG. 2, heater 10 may be installed at first pipe 21 as shown in FIG. 3. When the mixed liquid passing through first pipe 21 is heated by heater 10, the dissolved refrigerant becomes gas and is discharged from second pipe 22.

Definitions of Terms

Before explaining operations of refrigeration cycle apparatus 200, the following describes some terms used in the present specification.

The term "mixed liquid" refers to liquid in a state in which refrigerant is dissolved in refrigeration oil.

The term "surplus oil" refers to a surplus of refrigeration oil with respect to an appropriate amount of oil in compressor 1. Regarding the refrigeration oil sealed in the refrigeration cycle apparatus, an amount of oil (appropriate amount of oil) required by compressor 1 is changed depending on an operation state. Particularly, an appropriate amount of oil in a stable state is smaller than an appropriate amount of oil in a transition state (an operation in which a change of an actuator occurs transitionally such as starting or defrosting operation). Hence, when refrigeration oil is sealed therein in consideration of the transition state, a surplus of refrigeration oil exists in the stable state with respect to the appropriate amount of oil. This surplus of refrigeration oil is referred to as "surplus oil".

The term "overflow" refers to a phenomenon in which the mixed liquid is flooded from oil reservoir 6 to raise a liquid level in oil separator 2 when a flow rate of the mixed liquid flowing from pipe 21 into oil reservoir 6 is more than a flow rate of the mixed liquid flowing out to pipe 23. The overflow leads to extreme decrease of efficiency of separation between the oil and the refrigerant in oil separator 2.

The term "oil collection operation" refers to an operation for storing the refrigeration oil into oil reservoir 6 in a case where no oil exhaustion is concerned, such as a case where there is a sufficient amount of refrigeration oil in compressor 1.

The "oil returning operation" refers to an operation for returning the oil stored in oil reservoir 6 to compressor 1 in a case where oil exhaustion is concerned, such as a case where the operation frequency of compressor 1 is changed rapidly upon the starting, the defrosting operation, or the like.

(Explanation for Operation of Refrigeration Cycle Apparatus)

Figure 4:
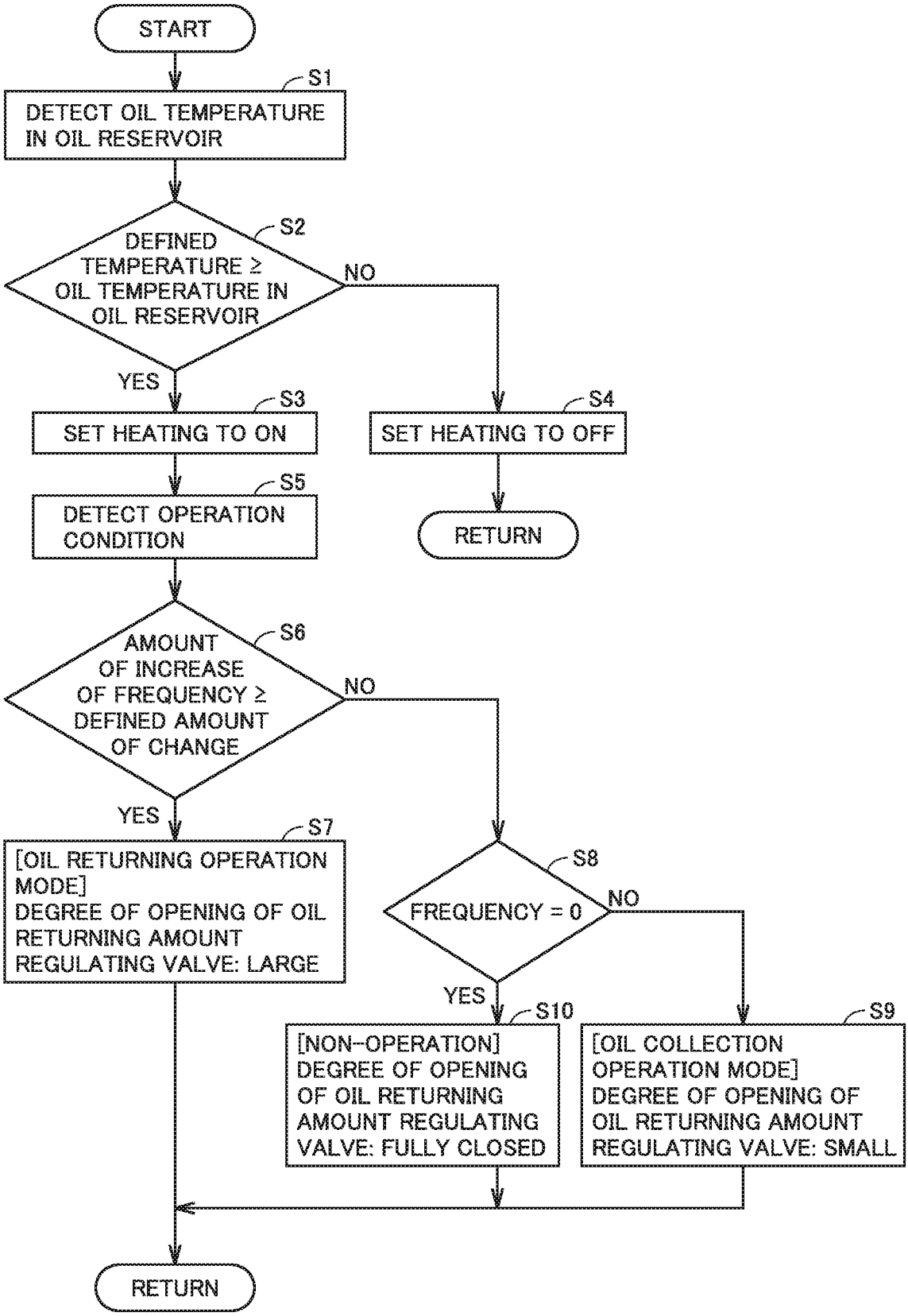
FIG. 4 is a flowchart for illustrating control performed by a controller 100 for a valve and a heater.

FIG. 4 is a flowchart for illustrating control performed by controller 100 for the valve and the heater. A process of this flowchart is invoked from a main routine for performing general control for refrigeration cycle apparatus 200 and is executed, whenever a certain period of time elapses or a starting condition is satisfied.

With reference to FIG. 1 and FIG. 4, when starting the operation, controller 100 detects a temperature of oil reservoir 6 using temperature sensor 50 in a step S1.

Then, in a step S2, controller 100 compares the temperature of oil reservoir 6 with a defined temperature. When the defined temperature<the temperature of the oil reservoir is satisfied (NO in S2), controller 100 sets heater 10 to OFF in a step S4 and the control returns to the main routine.

When the defined temperature the temperature≥of the oil reservoir is satisfied (YES in S2), controller 100 sets heater 10 to ON in a step S3, and detects an operation condition of refrigeration cycle apparatus 200 in a step S5. This operation condition also includes an operation frequency of compressor 1.

After step S5, in a step S6, controller 100 compares an amount of increase of the operation frequency of compressor 1 with a defined amount of change. When the operation frequency of compressor 1 is increased by more than or equal to the defined amount of change (YES in S6), a large amount of refrigeration oil is required in compressor 1. Hence, in a step S7, controller 100 sets an operation mode to an oil returning operation mode to attain a large degree of opening of oil returning amount regulating valve 13.

In the oil returning operation mode, the gas refrigerant and mixed liquid discharged from compressor 1 of FIG. 1 flow into oil separator 2. The gas refrigerant and the mixed liquid are separated from each other in oil separator 2, the gas refrigerant flows out to first heat exchanger 3 at the high-pressure side, and the mixed liquid flows into oil reservoir 6. The mixed liquid flowing into oil reservoir 6 is heated in oil reservoir 6 by heater 10 when the temperature of oil reservoir 6 is less than or equal to the defined temperature. Accordingly, the refrigerant in the mixed liquid is gasified to increase the oil concentration of the mixed liquid. The gas refrigerant passes from oil reservoir 6 through second pipe 22, and is discharged to low-pressure pipe 35 between compressor 1 and second heat exchanger 5 at the low-pressure side. The mixed liquid having a high oil concentration passes from oil reservoir 6 through third pipe 23, which serves as an oil removing pipe, and oil returning amount regulating valve 13. Then, the mixed liquid passes through low-pressure pipe 35 between compressor 1 and second heat exchanger 5 at the low-pressure side, and is supplied to compressor 1.

On the other hand, when the amount of increase of the operation frequency of compressor 1 is less than the defined amount of change in step S6 of FIG. 4 (NO in S6), controller 100 detects the frequency of compressor 1 in a step S8. Here, when the frequency is not zero and the amount of increase of the operation frequency of compressor 1 is less than the defined amount of change (NO in S8), the amount of required refrigeration oil in compressor 1 is a normal amount thereof. Hence, in a step S9, controller 100 sets the operation mode to the oil collection operation mode to attain a small degree of opening of oil returning amount regulating valve 13. The degree of opening of oil returning amount regulating valve 13 in this case is smaller than the degree of opening of oil returning amount regulating valve 13 in step S7.

In the oil collection operation mode, the mixed liquid separated by oil separator 2 of FIG. 1 flows into oil reservoir 6. When the temperature of oil reservoir 6 is less than or equal to the defined temperature, the mixed liquid flowing into oil reservoir 6 is heated in oil reservoir 6 by heater 10 to gasify the refrigerant in the mixed liquid, thereby increasing the oil concentration of the mixed liquid (decreasing the amount of refrigerant in the mixed liquid). The gas refrigerant discharged from the mixed liquid flows, via second pipe 22, into low-pressure pipe 35 between compressor 1 and second heat exchanger 5 at the low-pressure side. Since oil returning amount regulating valve 13 is closed, the mixed liquid increases the liquid level in oil reservoir 6. When the liquid level is increased to second pipe 22 installed at an upper portion in oil reservoir 6, the mixed liquid is discharged from oil reservoir 6 via second pipe 22. The mixed liquid flows into compressor 1 through low-pressure pipe 35.

On the other hand, when the operation frequency of compressor 1 is zero in step S8 of FIG. 4 (YES in S8), controller 100 brings the degree of opening of oil returning amount regulating valve 13 into a fully closed state in a step S10.

When the temperature of oil reservoir 6 is less than or equal to the defined temperature even while compressor 1 is non-operational, the mixed liquid is heated by heater 10 in oil reservoir 6. Accordingly, the refrigerant in the mixed liquid is gasified to increase the oil concentration of the mixed liquid. The gasified refrigerant is discharged from oil reservoir 6 through second pipe 22, and flows into low-pressure pipe 35.

When the degree of opening of oil returning amount regulating valve 13 is determined in one of steps S7, S9, and S10, the control is returned to the main routine.

As described above, according to the refrigeration cycle apparatus of the first embodiment, the following effects are obtained.

By storing surplus oil in oil reservoir 6, performance of compressor 1 can be improved.

Since decrease of the oil concentration in oil reservoir 6 while non-operational is suppressed by heater 10, reliability of compressor 1 can be improved by causing the mixed liquid having a high oil concentration to flow into compressor 1.

Even when the mixed liquid having a low oil concentration and discharged from compressor 1 during the oil returning operation mode flows into the oil reservoir, the oil concentration thereof is increased by the heating before flowing into compressor 1, whereby reliability of compressor 1 can be improved.

Since the oil concentration of the mixed liquid stored in oil reservoir 6 is increased and the refrigerant having been dissolved therein passes through gas removing pipe 22 to return to the refrigerant circuit 30 side, the amount of refrigerant sealed in refrigerant circuit 30 can be reduced. Moreover, even when the amount of refrigerant is small, the amount of refrigerant is close to an optimum amount of refrigerant, thereby improving performance of the refrigeration cycle apparatus.

Even when a large amount of mixed liquid is stored in oil reservoir 6, the refrigerant in the mixed liquid is gasified and flows out from the gas removing pipe, whereby overflow of oil reservoir 6 can be suppressed and the liquid level in oil separator 2 can be prevented from being increased. This allows for suppression of decrease in separation efficiency of oil separator 2 as well as suppression of oil exhaustion in compressor 1 due to an excess of oil being stored in oil separator 2.

By collecting the oil while removing gas via the gas removing pipe during the oil collection operation mode, an oil collection time can be shortened.

Moreover, although there is an optimum amount of refrigerant with which performance of the refrigeration cycle apparatus attains a peak value, the amount of refrigerant is deviated from the optimum amount of refrigerant by an amount of refrigerant dissolved in the oil of oil reservoir 6. Hence, it is necessary to add an amount of refrigerant corresponding to the amount of refrigerant dissolved therein; however, the amount of refrigerant to be added can be reduced because the refrigerant dissolved in the oil is gasified by heating oil reservoir 6, whereby the amount of refrigerant sealed therein can be reduced.

Second Embodiment

In a second embodiment, an oil concentration sensor is installed instead of the temperature sensor and the oil concentration sensor detects the oil concentration of the mixed liquid in the oil reservoir.

Figure 5:
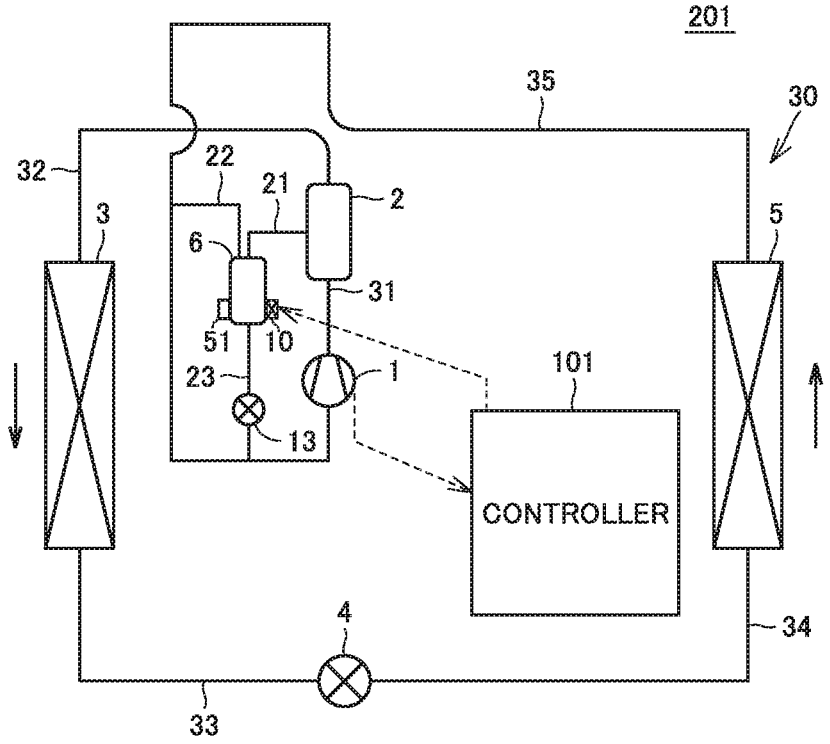
FIG. 5 shows a configuration of a refrigeration cycle apparatus according to a second embodiment.

FIG. 5 shows a configuration of a refrigeration cycle apparatus according to the second embodiment. A refrigeration cycle apparatus 201 shown in FIG. 5 includes: a refrigerant circuit 30 in which refrigerant circulates in the order of a compressor 1, an oil separator 2, a first heat exchanger 3, a decompressing apparatus 4, and a second heat exchanger 5 and returns to compressor 1; an oil reservoir 6; a first pipe 21; a second pipe 22; a third pipe 23; a heater 10; and an oil returning amount regulating valve 13.

These are the same as those of refrigeration cycle apparatus 200 of the first embodiment, and will not be repeatedly described.

Refrigeration cycle apparatus 200 further includes: an oil concentration sensor 51 configured to detect an oil concentration of liquid stored in oil reservoir 6; and a controller 101 configured to control heater 10 to heat refrigeration oil in accordance with the oil concentration detected by oil concentration sensor 51. Controller 101 controls heater 10 to heat the refrigeration oil when the oil concentration detected by oil concentration sensor 51 is lower than a defined oil concentration. Controller 101 controls an amount of heating of heater 10 to allow the oil concentration in the mixed liquid in oil reservoir 6 to coincide with the defined oil concentration.

Although oil concentration sensor 51 is configured to detect the concentration of the refrigeration oil in the mixed liquid of the refrigeration oil and the liquid refrigerant, oil concentration sensor 51 may be configured to detect a concentration of refrigerant in the mixed liquid. As oil concentration sensor 51, sensors for detecting concentrations in accordance with various methods can be used, such as a capacitance sensor, a sonic sensor, and an optical sensor, for example.

Figure 6:
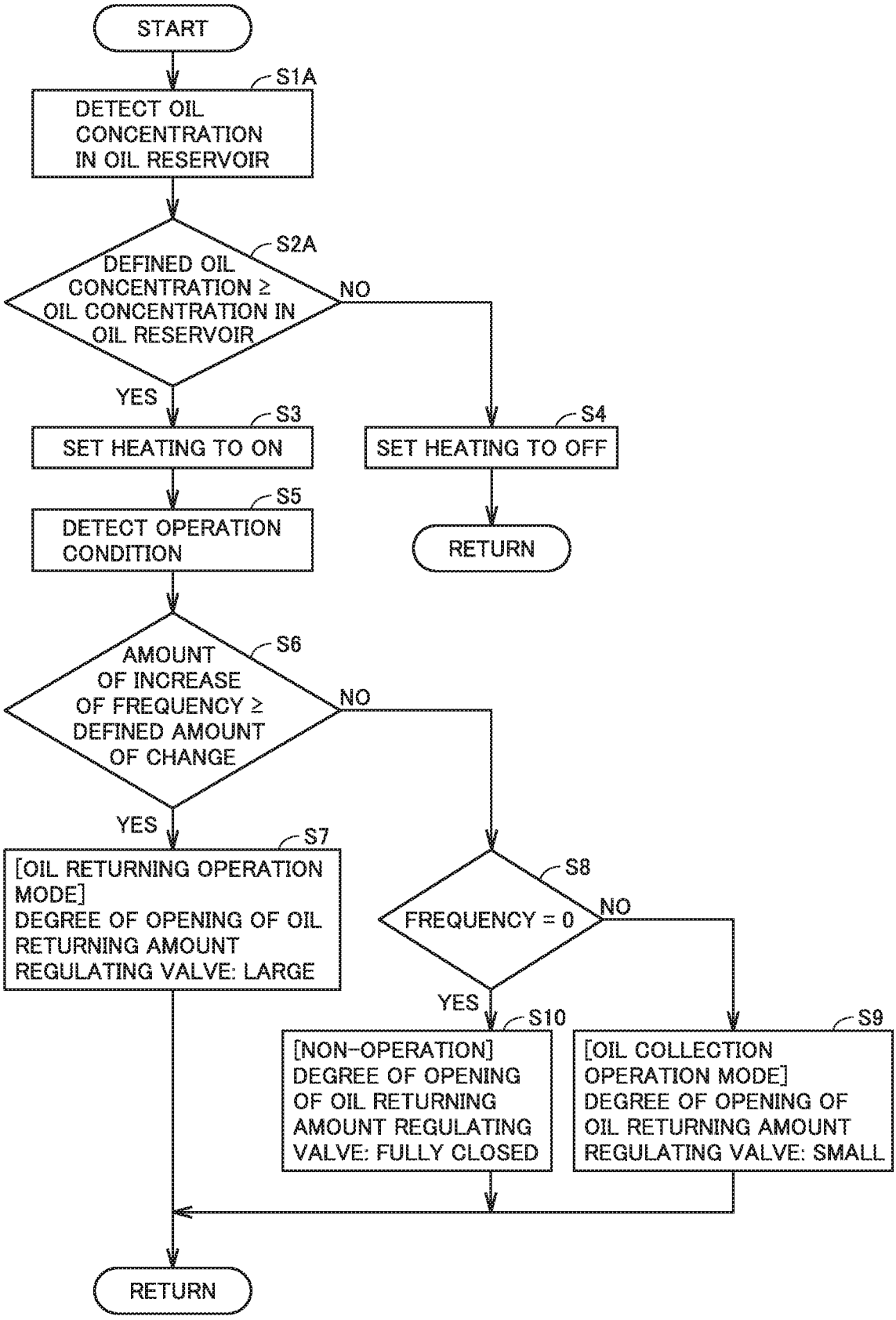
FIG. 6 is a flowchart for illustrating control performed by a controller 101 for a valve and a heater.

FIG. 6 is a flowchart for illustrating control performed by controller 101 for a valve and a heater. A process of this flowchart is invoked from a main routine for performing general control for refrigeration cycle apparatus 201 and is executed, whenever a certain period of time elapses or a starting condition is satisfied.

With reference to FIG. 5 and FIG. 6, when starting the operation, controller 100 detects an oil concentration in oil reservoir 6 using oil concentration sensor 51 in a step S1A.

Then, in a step S2A, controller 101 compares the oil concentration of oil reservoir 6 with a defined oil concentration.

Figure 7:
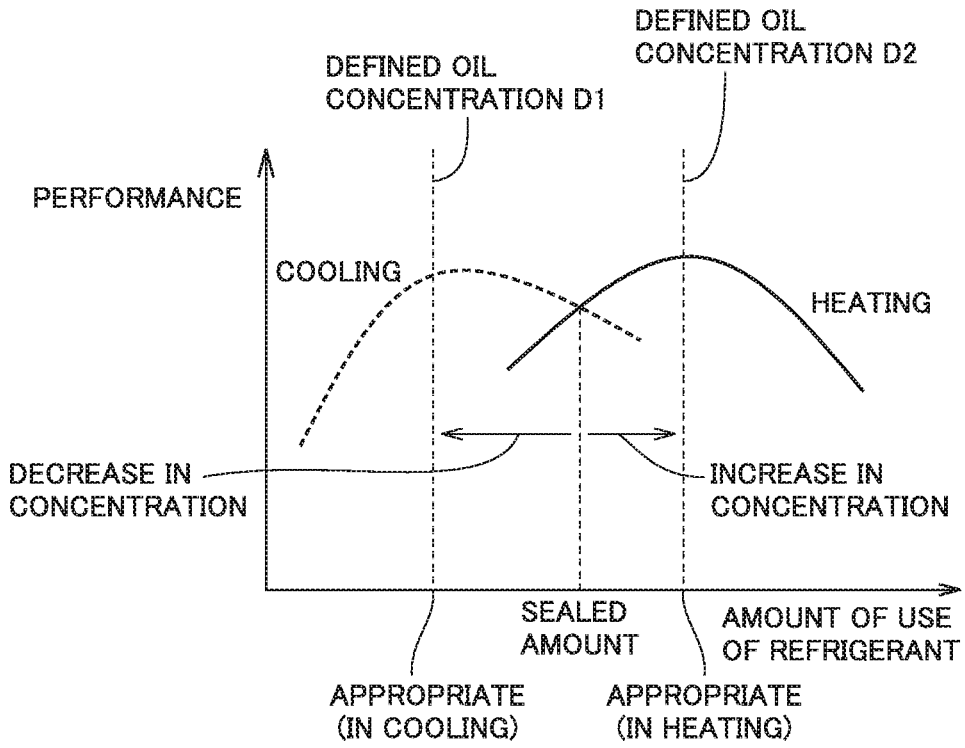
FIG. 7 illustrates a defined oil concentration.

FIG. 7 is a diagram for illustrating the defined oil concentration. As shown in FIG. 7, there are an oil concentration D1 at which performance of the refrigeration cycle apparatus is maximum when the refrigeration cycle apparatus performs cooling, and an oil concentration D2 at which performance of the refrigeration cycle apparatus is maximum when the refrigeration cycle apparatus performs heating. For example, when the amount of refrigerant sealed in refrigerant circuit 30 in the refrigerating cycle is deviated from an appropriate amount as shown in FIG. 7, the amount of refrigerant may be able to be adjusted to the appropriate oil concentration by changing the temperature of the refrigeration oil.

Figure 8:
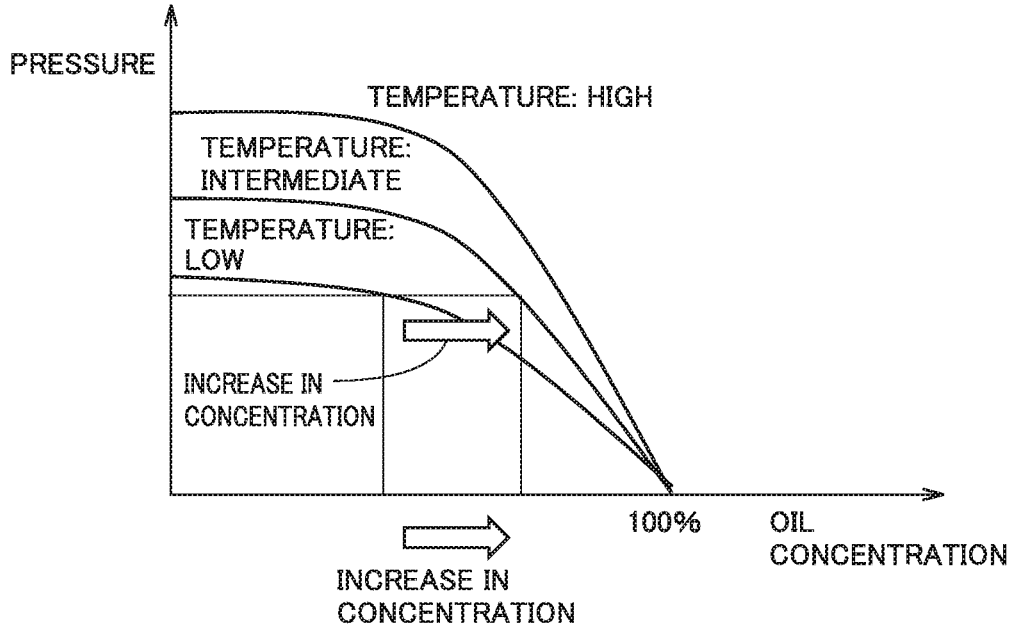
FIG. 8 shows a relation between an oil concentration in the mixed liquid and each of a pressure and a temperature.

FIG. 8 shows a relation between the oil concentration in the mixed liquid and each of pressure and temperature. As shown in FIG. 8, at the same temperature, pressure is lower as the oil concentration is higher. On the other hand, at the same pressure, the oil concentration is higher as the temperature is higher. Therefore, controller 101 detects the oil concentration and adjusts the oil concentration of the mixed liquid using heater 10 as required.

When the defined oil concentration<the oil concentration in the oil reservoir is satisfied in step S2A of FIG. 6 (NO in S2A), controller 101 sets heater 10 to OFF in a step S4 and the control returns to the main routine.

When the defined oil concentration≥the oil concentration in the oil reservoir is satisfied (YES in S2A), controller 101 sets heater 10 to ON in a step S3, and detects an operation condition of refrigeration cycle apparatus 200 in a step S5. This operation condition also includes an operation frequency of compressor 1.

After step S5, in a step S6, controller 100 compares an amount of increase of the operation frequency of compressor 1 with a defined amount of change. When the operation frequency of compressor 1 is increased by more than or equal to the defined amount of change (YES in S6), a large amount of refrigeration oil is required in compressor 1. Hence, in a step S7, controller 100 sets an operation mode to an oil returning operation mode to attain a large degree of opening of oil returning amount regulating valve 13.

On the other hand, when the amount of increase of the operation frequency of compressor 1 is less than the defined amount of change (NO in S6), controller 100 detects the frequency of compressor 1 in a step S8. Here, when the frequency is not zero and the amount of increase of the operation frequency of compressor 1 is less than the defined amount of change (NO in S8), the amount of required refrigeration oil in compressor 1 is a normal amount thereof. Hence, in a step S9, controller 100 sets the operation mode to the oil collection operation mode to attain a small degree of opening of oil returning amount regulating valve 13. The degree of opening on this occasion is smaller than the degree of opening set in step S7.

On the other hand, when the operation frequency of compressor 1 is zero (YES in S8), controller 100 brings the degree of opening of oil returning amount regulating valve 13 into a fully closed state in a step S10.

When the degree of opening of oil returning amount regulating valve 13 is determined in one of steps S7, S9, and S10, the control is returned to the main routine.

It should be noted that details about the flows of the refrigerant and oil in the oil returning operation mode in step S7, the oil collection operation mode in step S9, and the non-operation mode in step S10 are the same as those in the first embodiment, and therefore will not described repeatedly.

It should be noted that the heating when an outdoor temperature is low may be combined with the heating control that is based on the oil concentration.

Figure 9:
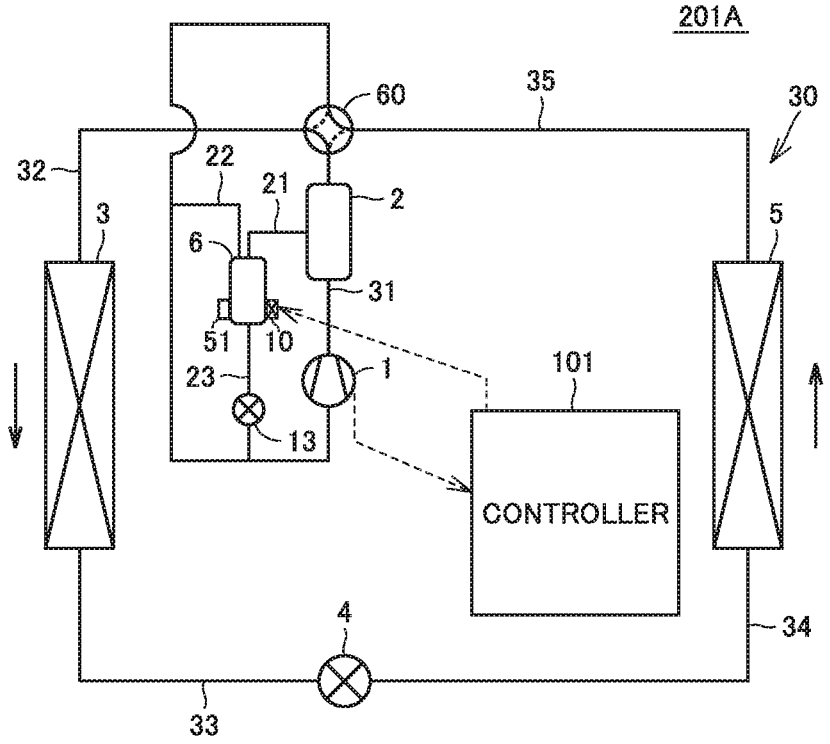
FIG. 9 shows a configuration of a refrigeration cycle apparatus according to a modification of the second embodiment.

FIG. 9 shows a configuration of a refrigeration cycle apparatus according to a modification of the second embodiment. A refrigeration cycle apparatus 201A shown in FIG. 9 is obtained by adding a four-way valve 60 to refrigeration cycle apparatus 201 shown in FIG. 5.

In refrigeration cycle apparatus 201A according to the modification of the second embodiment, a defined oil concentration is changed in accordance with an operation state of the refrigeration cycle apparatus.

FIG. 7 shows that an appropriate amount of use of refrigerant with which performance is maximum differs between cooling and heating. In this case, an optimum value of the oil concentration in oil reservoir 6 also differs between the cooling and the heating. In the refrigeration cycle apparatus switchable between the cooling and the heating, an amount of refrigerant sealed in refrigerant circuit 30 is frequently set to an intermediate point between the appropriate amount in the cooling and the appropriate amount in the heating as shown in FIG. 7.

That is, the amount of refrigerant sealed therein in FIG. 7 is a defined amount of refrigerant sealed in the outdoor unit at the time of shipping. The appropriate amount of use of refrigerant in the heating is more than the amount of refrigerant sealed therein, whereas the appropriate amount of use of refrigerant in the cooling is less than the amount of refrigerant sealed therein. On this occasion, by monitoring the concentration using oil concentration sensor 51 to adjust the amount of heating, the amount of use of refrigerant can be adjusted to each of the appropriate amount in the cooling and the appropriate amount in the heating.

Therefore, when refrigeration cycle apparatus 201A is operated to switch between the cooling and the heating, the defined oil concentration in step S2A of FIG. 6 is switched between that in the cooling operation and that in the heating operation.

The defined oil concentration is set to satisfy a defined oil concentration D1<a defined oil concentration D2, where defined oil concentration D1 represents a defined oil concentration when performing an operation in which an internal volume of the high-pressure side heat exchanger<an internal volume of the low-pressure side heat exchanger is satisfied, and defined oil concentration D2 represents a defined oil concentration when performing an operation in which the internal volume of the high-pressure side heat exchanger>the internal volume of the low-pressure side heat exchanger is satisfied.

As described above, according to the refrigeration cycle apparatus of each of the second embodiment and the modification, the following effects are obtained.

Since the oil concentration is detected instead of estimating the oil concentration from the temperature, reliability of compressor 1 can be improved.

Since heating is performed at an appropriate amount of heating based on an oil concentration in order to increase the concentration to a defined concentration, power consumption for the heating can be suppressed.

An appropriate amount of refrigerant differs depending on an operation state. By changing the defined oil concentration depending on the operation state, the amount of refrigerant dissolved in the mixed liquid is adjusted and the refrigerant is discharged into refrigerant circuit 30, whereby performance can be improved depending on the operation state.

Since the oil concentration can be managed at the appropriate value with respect to the amount of refrigerant sealed therein, an extra amount of refrigerant corresponding to an amount of refrigerant to be dissolved into the oil does not need to be sealed, whereby the amount of refrigerant can be reduced.

Other Modifications

It can be considered to make the following modification as to the position of heater 10 in addition to the modification shown in FIG. 3.

For example, the installation position of heater 10 can be close to third pipe 23 serving as the oil removing pipe of oil reservoir 6 (heater 10 is provided at a lower side to securely heat even when the amount of oil is small). Since heater 10 is installed near third pipe 23, the mixed liquid can be heated even when the liquid level in oil reservoir 6 is decreased, whereby the oil concentration can be increased.

In this modification, even when the oil is unable to be sufficiently stored in oil reservoir 6, efficiency of heating is increased because a position at which the mixed liquid exists is heated, whereby power consumption can be suppressed. Moreover, by heating the mixed liquid to discharge the refrigerant dissolved in the oil even when the amount thereof stored in oil reservoir 6 is small, the oil concentration is increased, whereby reliability of compressor 1 can be improved.

As another modification, heater 10 for oil reservoir 6 may be installed at the discharge pipe of compressor 1. The oil does not become thin by heating the refrigerant in the mixed liquid into gas while flowing from compressor 1 to oil reservoir 6. Even when heater 10 is installed at the discharge pipe of compressor 1, the oil concentration of the mixed liquid can be increased before the discharged mixed liquid having a low concentration flows into oil reservoir 6. By increasing the oil concentration of the mixed liquid before the mixed liquid having a low oil concentration and discharged from compressor 1 flows into the oil reservoir, reliability of compressor 1 can be improved.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

REFERENCE SIGNS LIST

1: compressor; 2: oil separator; 3: first heat exchanger; 4: decompressing apparatus; 5: second heat exchanger; 6: oil reservoir; 6L: lower base surface; 6U: upper base surface; 10: heater; 13: oil returning amount regulating valve; 21: first pipe; 22: second pipe; 23: third pipe; 30: refrigerant circuit; 31, 32: pipe; 35: low-pressure pipe; 50: temperature sensor; 51: oil concentration sensor; 60: four-way valve; 100, 101: controller; 200, 201, 201A: refrigeration cycle apparatus.

The invention claimed is:

1. A refrigeration cycle apparatus comprising:

a refrigerant circuit in which refrigerant circulates in the order of a compressor, an oil separator, a first heat exchanger, a decompressing apparatus, and a second heat exchanger and returns to the compressor;

an oil reservoir configured to store refrigeration oil;

a first pipe that connects the oil separator and the oil reservoir, the first pipe being configured to send the refrigeration oil separated by the oil separator to the oil reservoir;

a second pipe that connects the oil reservoir and a suction side of the compressor;

a third pipe that connects the oil reservoir and the suction side of the compressor at a position lower than a position at which the second pipe is connected to the oil reservoir;

a heater installed at the first pipe and configured to heat, in the first pipe, the refrigeration oil separated by the oil separator;

a temperature sensor configured to detect a temperature of the oil reservoir; and a controller configured to control the heater to heat the refrigeration oil when the temperature detected by the temperature sensor is lower than a defined temperature.

2. The refrigeration cycle apparatus according to claim 1, further comprising a flow rate regulating valve provided at the third pipe.

* * * * *